US009153878B2

(12) United States Patent
Poma et al.

(10) Patent No.: US 9,153,878 B2
(45) Date of Patent: Oct. 6, 2015

(54) TERMINATION ASSEMBLY FOR A SHIELDED CABLE AND METHOD OF ASSEMBLING

(71) Applicant: DELPHI TECHNOLOGIES, INC., Troy, MI (US)

(72) Inventors: Eric B. Poma, Hubbard, OH (US); Kurt Paul Seifert, Cortland, OH (US); William J. Palm, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 74 days.

(21) Appl. No.: 14/065,873

(22) Filed: Oct. 29, 2013

(65) Prior Publication Data

US 2015/0118917 A1 Apr. 30, 2015

(51) Int. Cl.

| | |
|---|---|
| ***H01R 9/05*** | (2006.01) |
| ***H01R 4/18*** | (2006.01) |
| ***H01R 43/05*** | (2006.01) |
| ***H01R 4/10*** | (2006.01) |

(52) U.S. Cl.

CPC ..... *H01R 4/184* (2013.01); *H01R 4/10* (2013.01); *H01R 9/05* (2013.01); *H01R 43/05* (2013.01)

(58) Field of Classification Search

CPC ..... H01R 4/10; H01R 4/183; H01R 4/185; H01R 9/03

USPC ..... 439/877, 578–595, 733.1

See application file for complete search history.

(56) References Cited

U.S. PATENT DOCUMENTS

| | | | | |
|---|---|---|---|---|
| 3,538,239 | A | 11/1970 | Renshaw, Jr. | |
| 4,415,223 | A | 11/1983 | Asick | |
| 5,145,409 | A * | 9/1992 | Sato et al. | 439/585 |
| 5,246,384 | A * | 9/1993 | Sato | 439/585 |
| 5,603,636 | A * | 2/1997 | Kanou et al. | 439/585 |
| 6,384,335 | B1 | 5/2002 | Saito et al. | |

(Continued)

FOREIGN PATENT DOCUMENTS

| | | | |
|---|---|---|---|
| JP | 06-070440 | A | 3/1994 |
| JP | 2000-323246 | A | 11/2000 |

(Continued)

OTHER PUBLICATIONS

U.S. Appl. No. 13/795,046, filed Mar. 12, 2013.
International Search Report dated Dec. 11, 2014.

*Primary Examiner* — Abdullah Riyami
*Assistant Examiner* — Harshad Patel
(74) *Attorney, Agent, or Firm* — Thomas N. Tuoney

(57) ABSTRACT

A method is provided for attaching a termination arrangement to a shielded cable which includes a conductive core, a core insulation layer, a conductive shield layer, and an outer insulation layer. A length of the outer insulation layer is removed to expose an end portion of the conductive shield layer and a length of the core insulation layer is removed to expose a portion of the conductive core. The termination assembly is provided having a terminal, a core crimp section in electrical communication with the terminal, and an inner ferrule section connected to the core crimp section. The core crimp section is positioned adjacent to the exposed conductive core and crimped around said conductive core in electrical contact therewith. The inner ferrule section is positioned adjacent to the exposed conductive shield layer and crimped around the core insulation layer. The core crimp section is separated from the inner ferrule section.

10 Claims, 6 Drawing Sheets

(56) References Cited

U.S. PATENT DOCUMENTS

| | | | | |
|---|---|---|---|---|
| 6,793,532 | B2 | 9/2004 | Saito et al. | |
| 7,160,150 | B2 * | 1/2007 | Annequin | 439/585 |
| 7,598,455 | B2 | 10/2009 | Gump et al. | |
| 2014/0259660 | A1 * | 9/2014 | Poma et al. | 29/862 |

FOREIGN PATENT DOCUMENTS

| | | | |
|---|---|---|---|
| JP | 2002-218640 | A | 8/2002 |
| KR | 10-2007-0118486 | A | 12/2007 |

* cited by examiner

TERMINATION ASSEMBLY FOR A SHIELDED CABLE AND METHOD OF ASSEMBLING

TECHNICAL FIELD OF INVENTION

The present invention relates to a shielded cable; more particularly to a termination assembly for the shielded cable; and still even more particularly to a method for assembling the termination assembly to the shielded cable.

BACKGROUND OF INVENTION

Cables are known for transmitting electrical current and/or signals from a first device to a second device. In an example shown in U.S. Pat. No. 7,598,455 on Oct. 6, 2009 to Gump et al., a shielded cable includes a conductive core surrounded by a core insulation layer to electrically insulate the conductive core. The core insulation layer is surrounded by a conductive shield layer in the form of a metallic braid that is woven around the core insulation layer in order to shield any electronic devices in the vicinity of the cable from electromagnetic interference (EMI) caused by electric current flowing through the conductive core. An outer insulation layer surrounds the conductive shield layer. The end of the cable is cut circumferentially at three axial spaced locations with the cuts being successively deeper in order to expose lengths of the conductive core, core insulation layer, and conductive shield layer. In order to ground the conductive shield layer, an annular inner ferrule is disposed between the core insulation layer and the exposed portion of the conductive shield layer and an annular outer ferrule is disposed around the exposed portion of the conductive shield layer and crimped thereto, thereby capturing the conductive shield layer between the inner ferrule and the outer ferrule. The inner ferrule and outer ferrule are loose-piece and are manufactured using deep drawing or machining processes, thereby requiring the inner ferrule and outer ferrule to be manually assembled to the cable. Furthermore, the terminal attached to the conductive core is also loose piece and must be handled separately from the inner ferrule and the outer ferrule.

U.S. Pat. No. 3,538,239 to Henshaw on Nov. 3, 1970 teaches an inner and outer ferrule for a shielded cable where the inner ferrule and the outer ferrule are connected together by a strap and integrally formed together from sheet metal where the inner ferrule is formed into an annular shape and the outer ferrule is formed into a U-shape prior to the inner ferrule and outer ferrule being applied to the shielded cable. While this inner and outer ferrule arrangement may allow manufacture of the inner ferrule and the outer ferrule to be to be automated, it may be difficult to position the inner ferrule between the core insulation layer and the conductive shield layer. Furthermore, the inner ferrule being formed into an annular shape prior to being assembled to the shielded cable limits its use to a single gauge size of wire. While not shown, a terminal that would be applied to a conductive core of the shielded cable would need to be loose piece and handled separately from the inner ferrule and the outer ferrule.

What is needed is a termination arrangement for a shielded cable which minimizes or eliminates one or more of the shortcomings as set forth above.

SUMMARY OF THE INVENTION

Briefly described, a method is provided for attaching a termination arrangement to a shielded cable which includes a conductive core, a core insulation layer radially surrounding the conductive core, a conductive shield layer radially surrounding the core insulation layer, and an outer insulation layer radially surrounding the conductive shield layer. The method includes removing a length of the outer insulation layer to expose an end portion of the conductive shield layer and removing a length of the core insulation layer to expose a portion of the conductive core. The termination assembly is provided having a terminal, a core crimp section in electrical communication with the terminal and configured to be crimped around the conductive core, and an inner ferrule section connected to the core crimp section and configured to be crimped around the core insulation layer. The core crimp section is positioned adjacent to the portion of the conductive core that has been exposed and crimped around said conductive core in electrical contact therewith. The inner ferrule section is positioned adjacent to the end portion of the conductive shield layer that has been exposed and crimped around the core insulation layer. The core crimp section is separated from the inner ferrule section.

BRIEF DESCRIPTION OF DRAWINGS

This invention will be further described with reference to the accompanying drawings in which.

DETAILED DESCRIPTION OF INVENTION

Figure 1:
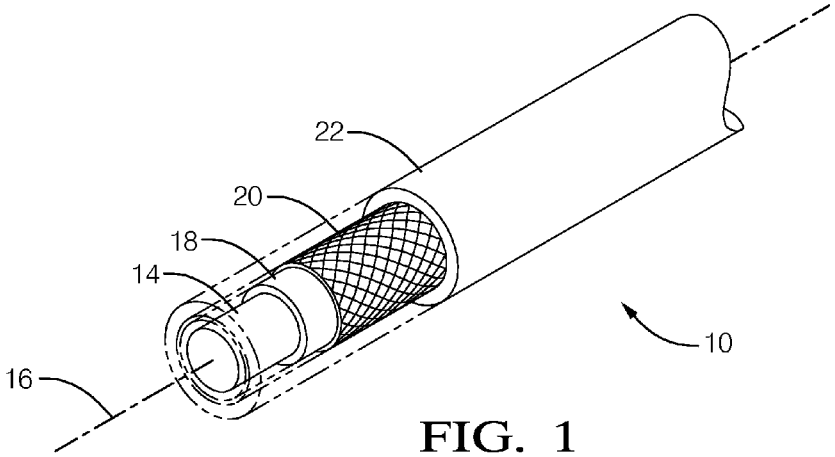
FIG. 1 is an isometric view of a shielded cable for receiving a termination assembly in accordance the present invention.
Figure 2:
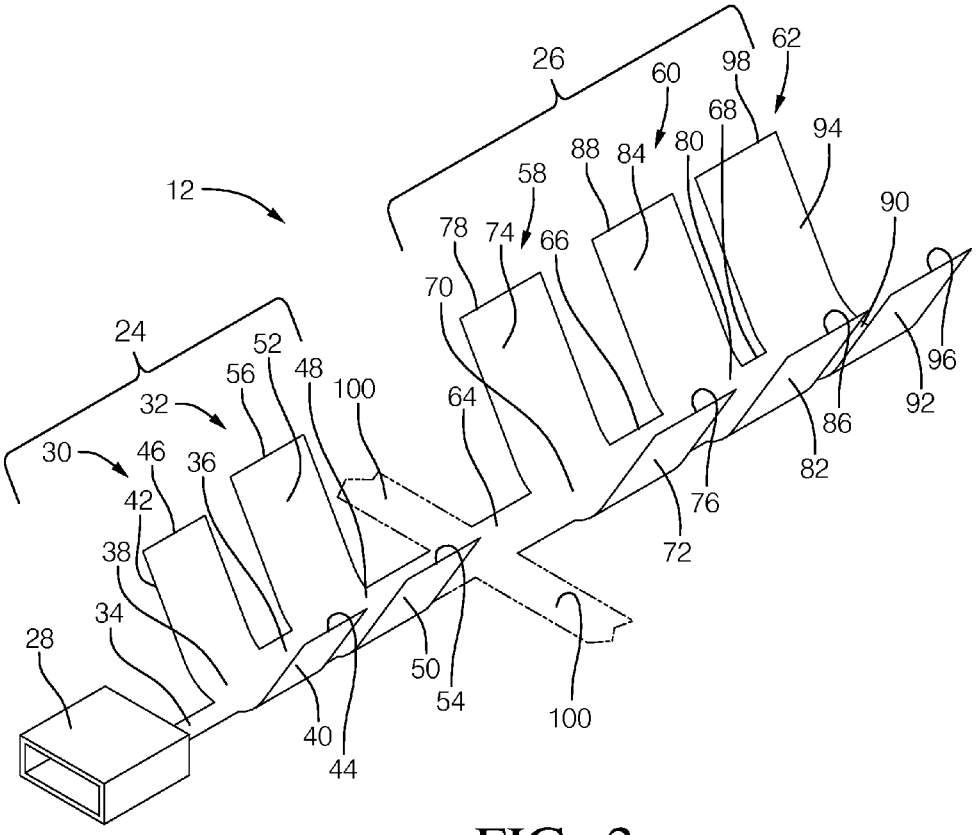
FIG. 2 is an isometric view of the termination assembly in accordance with the present invention.

Referring to FIGS. 1 and 2, an isometric view of a shielded cable 10 is shown which has been prepared to receive a termination assembly 12. Shielded cable 10 includes a conductive core 14 extending along a shielded cable axis 16, a core insulation layer 18 coaxially and radially surrounding conductive core 14, a conductive shield layer 20 coaxially and radially surrounding core insulation layer 18, and an outer insulation layer 22 coaxially and radially surrounding conductive shield layer 20. Conductive core 14 is a metallic material, for example only, copper, aluminum, alloys thereof, or any other metallic material suitable for conducting electricity. Core insulation layer 18 and outer insulation layer 22 are made of an electrically insulative material. Conductive shield layer 20 is a metallic material, for example only, braided metal wire woven around core insulation layer 18 that is suitable for conducting electricity. Conductive shield layer 20 may shield electronic devices in the vicinity of shielded cable 10 from EMI caused by electric current flowing through conductive core 14. Conductive shield layer 20 may also protect the signal flowing through conductive core 14 from outside influence.

Figure 3:
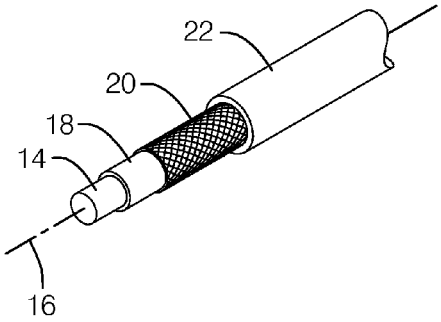
FIGS. 3-10 show a progression of steps for assembling the termination assembly to the shielded cable.
Figure 11:
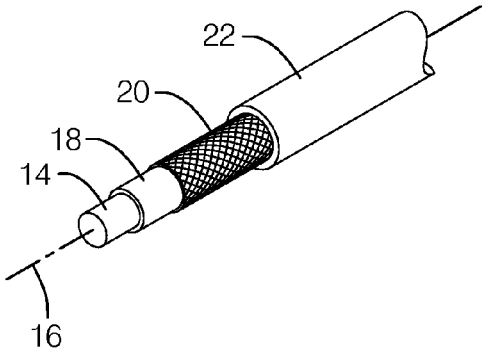
FIGS. 11-19 show another progression of steps for assembling the termination assembly to the shielded cable.

With continued reference to FIG. 1 and with additional reference to FIGS. 3 and 11, shielded cable 10 has been prepared to receive termination assembly 12 by cutting the end portion of shielded cable 10 in three axially spaced locations with each cut being successively deeper so that a portion of outer insulation layer 22 may be removed to expose an end portion of conductive shield layer 20, a portion of conductive shield layer 20 may be removed to expose core insulation layer 18, and a portion of core insulation layer 18 may be removed to expose conductive core 14. The portions of outer insulation layer 22, conductive shield layer 20, and core insulation layer 18 that are removed are illustrated as phantom lines in FIG. 1.

Now with reference to FIG. 2, termination assembly 12 includes a conductive core termination section 24 and a conductive shield termination section 26. Conductive core termination section 24 is used to terminate conductive core 14, thereby providing an interface suitable for connecting conductive core 14 to other devices or cables (not shown). Conductive shield termination section 26 is used to terminate conductive shield layer 20, thereby providing a path from conductive shield layer 20 to ground in order to dissipate EMI. Conductive core termination section 24, conductive shield termination section 26, and methods for assembling termination assembly 12 to shielded cable 10 will be describe in the paragraphs that follow.

With continued reference to FIG. 2, conductive core termination section 24 includes a terminal 28, a core crimp section 30 in electrical communication with terminal 28 and configured to be crimped around conductive core 14, and a core insulation crimp section 32 connected to core crimp section 30 and configured to be crimped around core insulation layer 18. While terminal 28 has been illustrated as a female terminal, it should be understood that terminal 28 may alternatively be a male terminal and may take the form of any terminal used in the electrical terminal art, for example only, blades, rings, spades, boxes, pins, and sockets which are suitable for mating with a corresponding terminal (not shown) to which terminal 28 is to be connected. Terminal 28 may be connected to core crimp section 30 by a terminal to core crimp section strap 34. Similarly, core crimp section 30 may be connected to core insulation crimp section 32 by a core crimp section to core insulation crimp section strap 36 such that core crimp section 30 is axially between terminal 28 and core insulation crimp section 32.

Core crimp section 30 includes a core crimp section base portion 38, a first core crimp section crimp wing 40, and a second core crimp section crimp wing 42. First core crimp section crimp wing 40 and second core crimp section crimp wing 42 extend from opposing sides of core crimp section base portion 38 such that core crimp section 30 may be substantially V-shaped or U-shaped as shown in FIG. 2 prior to assembly of core crimp section 30 to shielded cable 10. Core crimp section base portion 38 may be arcuate in shape as shown. First core crimp section crimp wing 40 is attached at one end to core crimp section base portion 38 while the other end is free and defines a first core crimp section crimp wing free end 44. Similarly, second core crimp section crimp wing 42 is attached at one end to core crimp section base portion 38 while the other end is free and defines a second core crimp section crimp wing free end 46. Terminal to core crimp section strap 34 extends from core crimp section base portion 38 to terminal 28 to connect core crimp section 30 and terminal 28 and to provide electrical communication therebetween. Assembly of core crimp section 30 to shielded cable 10 will be discussed in detail later.

Core insulation crimp section 32 includes a core insulation crimp section base portion 48, a first core insulation crimp section crimp wing 50, and a second core insulation crimp section crimp wing 52. First core insulation crimp section crimp wing 50 and second core insulation crimp section crimp wing 52 extend from opposing sides of core insulation crimp section base portion 48 such that core insulation crimp section 32 may be substantially V-shaped or U-shaped as shown in FIG. 2 prior to assembly of core insulation crimp section 32 to shielded cable 10. Core insulation crimp section base portion 48 may be arcuate in shape as shown. First core insulation crimp section crimp wing 50 is attached at one end to core insulation crimp section base portion 48 while the other end is free and defines a first core insulation crimp section crimp wing free end 54. Similarly, second core insulation crimp section crimp wing 52 is attached at one end to core insulation crimp section base portion 48 while the other end is free and defines a second core insulation crimp section crimp wing free end 56. Core crimp section to core insulation crimp section strap 36 extends from core insulation crimp section base portion 48 to core crimp section base portion 38 to connect core insulation crimp section 32 to core crimp section 30. Assembly of core insulation crimp section 32 to shielded cable 10 will be discussed in detail later.

With continued reference to FIG. 2, conductive shield termination section 26 includes an inner ferrule section 58 attached to core insulation crimp section 32 and configured to be crimped around core insulation layer 18, an outer ferrule section 60 attached to inner ferrule section 58 and configured to be crimped around inner ferrule section 58 and conductive shield layer 20, and an outer ferrule grounding section 62 attached to outer ferrule section 60 and configured to be crimped around outer insulation layer 22. Inner ferrule section 58 may be connected to core insulation crimp section 32 by a core insulation crimp section to inner ferrule section strap 64 such that core insulation crimp section 32 is axially between core crimp section 30 and inner ferrule section 58. Similarly, outer ferrule section 60 may be connected to inner ferrule section 58 by an inner ferrule section to outer ferrule section strap 66 such that inner ferrule section 58 is axially between core insulation crimp section 32 and outer ferrule section 60. Also similarly, outer ferrule grounding section 62 may be connected to outer ferrule section 60 by an outer ferrule section to outer ferrule grounding section strap 68 such that outer ferrule section 60 is axially between inner ferrule section 58 and outer ferrule grounding section 62.

Inner ferrule section 58 includes an inner ferrule section base portion 70, a first inner ferrule crimp wing 72, and a second inner ferrule crimp wing 74. First inner ferrule crimp wing 72 and second inner ferrule crimp wing 74 extend from opposing sides of inner ferrule section base portion 70 such that inner ferrule section 58 may be substantially V-shaped or U-shaped as shown in FIG. 2 prior to assembly of inner ferrule section 58 to shielded cable 10. Inner ferrule section base portion 70 may be arcuate in shape as shown. First inner ferrule crimp wing 72 is attached at one end to inner ferrule section base portion 70 while the other end is free and defines a first inner ferrule crimp wing free end 76. Similarly, second inner ferrule crimp wing 74 is attached at one end to inner ferrule section base portion 70 while the other end is free and defines a second inner ferrule crimp wing free end 78. Core insulation crimp section to inner ferrule section strap 64 extends from inner ferrule section base portion 70 to core insulation crimp section base portion 48 to connect inner ferrule section 58 and core insulation crimp section 32. Assembly of inner ferrule section 58 to shielded cable 10 will be discussed in detail later.

Outer ferrule section 60 includes an outer ferrule section base portion 80, a first outer ferrule crimp wing 82 and a second outer ferrule crimp wing 84. First outer ferrule crimp wing 82 and second outer ferrule crimp wing 84 extend from opposing sides of outer ferrule section base portion 80 such that outer ferrule section 60 may be substantially V-shaped or U-shaped as shown in FIG. 2 prior to assembly of outer ferrule section 60 to shielded cable 10. Outer ferrule section base portion 80 may be arcuate in shape as shown. First outer ferrule crimp wing 82 is attached at one end to outer ferrule section base portion 80 while the other end is free and defines a first outer ferrule crimp wing free end 86. Similarly, second outer ferrule crimp wing 84 is attached at one end to outer ferrule section base portion 80 while the other end is free and defines a second outer ferrule crimp wing free end 88. Inner ferrule section to outer ferrule section strap 66 extends from outer ferrule section base portion 80 to inner ferrule section base portion 70 to connect outer ferrule section 60 and inner ferrule section 58. Assembly of outer ferrule section 60 to shielded cable 10 will be discussed in detail later.

Outer ferrule grounding section 62 includes an outer ferrule grounding section base portion 90, a first outer ferrule grounding wing 92, and a second outer ferrule grounding wing 94. First outer ferrule grounding wing 92 and second outer ferrule grounding wing 94 extend from opposing sides of outer ferrule grounding section base portion 90 such that outer ferrule grounding section 62 may be substantially V-shaped or U-shaped as shown in FIG. 2 prior to assembly of outer ferrule grounding section 62 to shielded cable 10. Outer ferrule grounding section base portion 90 may be arcuate in shape as shown. First outer ferrule grounding wing 92 is attached at one end to outer ferrule grounding section base portion 90 while the other end is free and defines a first outer ferrule grounding wing free end 96. Similarly, second outer ferrule grounding wing 94 is attached at one end to outer ferrule grounding section base portion 90 while the other end is free and defines a second outer ferrule grounding wing free end 98. Outer ferrule section to outer ferrule grounding section strap 68 extends from outer ferrule grounding section base portion 90 to outer ferrule section base portion 80 to connect outer ferrule grounding section 62 and outer ferrule section 60 and to provide electrical communication therebetween. Outer ferrule grounding section 62 is provided for connection to ground or a conductor connected to ground, thereby grounding conductive shield layer 20. While outer ferrule grounding section 62 has been illustrated and described, outer ferrule grounding section 62 may be omitted. If outer ferrule grounding section 62 is omitted, outer ferrule section 60 is connected directly to ground or directly to a conductor connected to ground, thereby grounding conductive shield layer 20. Assembly of outer ferrule grounding section 62 to shielded cable 10 will be discussed in detail later.

Termination assembly 12 may be formed from a sheet of electrically conductive sheet stock by conventional metal forming techniques such as punching and stamping. As shown in FIG. 2, termination assembly 12 may be formed with a carrier strip 100 extending laterally from both sides of core insulation crimp section to inner ferrule section strap 64. While not shown, carrier strip 100 may include a plurality of termination assemblies 12 in order to facilitate automated production of termination assemblies 12 and also to facilitate automated assembly of termination assembly 12 to shielded cable 10. While carrier strip 100 is illustrated as connected to termination assembly 12 at core insulation crimp section to inner ferrule section strap 64, it should be understood that carrier strip 100 may alternatively be connected to termination assembly 12 at other locations on termination assembly 12.

Figure 4:
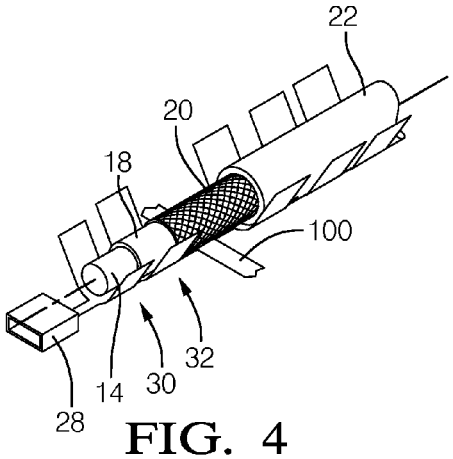

A first embodiment of assembling termination assembly 12 to shielded cable 10 will now be discussed with reference to FIGS. 3-10. As shown in FIG. 3, shielded cable 10 has been prepared as previously described in order to receive termination assembly 12. After shielded cable 10 has been prepared to receive termination assembly 12, core crimp section 30 is positioned radially adjacent to the end portion of conductive core 14 that has been exposed by removing a length of core insulation layer 18 as shown in FIG. 4. Simultaneously, core insulation crimp section 32 is positioned radially adjacent to the end portion of core insulation layer 18 that has been exposed by removing a length of conductive shield layer 20. Core crimp section 30 is also positioned to axially abut or to be axially proximal to core insulation layer 18. Similarly, core insulation crimp section 32 is also positioned to be axially proximal to conductive shield layer 20. Positioning core crimp section 30 and core insulation crimp section 32 as describe results in terminal 28 being positioned axially beyond the end of conductive core 14.

Figure 5:
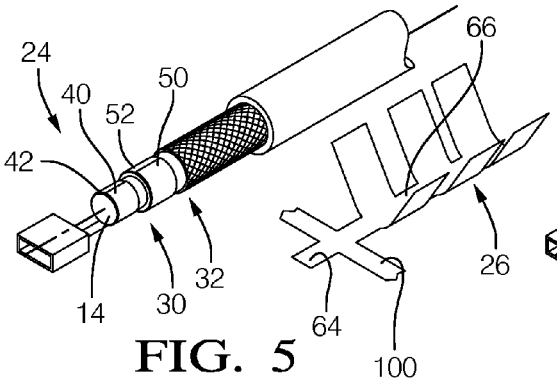

First core crimp section crimp wing 40 and second core crimp section crimp wing 42 are then crimped or deformed around conductive core 14 and first core insulation crimp section crimp wing 50 and second core insulation crimp section crimp wing 52 are crimped or deformed around core insulation layer 18 as shown in FIG. 5, thereby fixing core crimp section 30 in electrical communication with conductive core 14 and fixing core insulation crimp section 32 to core insulation layer 18 to provide strain relief to conductive core 14. The same process which fixes core crimp section 30 to conductive core 14 and core insulation crimp section 32 to core insulation layer 18 may also separate conductive core termination section 24 from core insulation crimp section to inner ferrule section strap 64. In this way, conductive core termination section 24 is also separated from carrier strip 100 and conductive shield termination section 26. It should be noted that carrier strip 100 remains attached to conductive shield termination section 26 at this point in the process. It should also be noted that the crimp style of first core crimp section crimp wing 40 and second core crimp section crimp wing 42 around conductive core 14 is shown in the figures for illustrative purposes only and any known crimp style may be used, for example only, an f-crimp or an overlap crimp.

Figure 6:
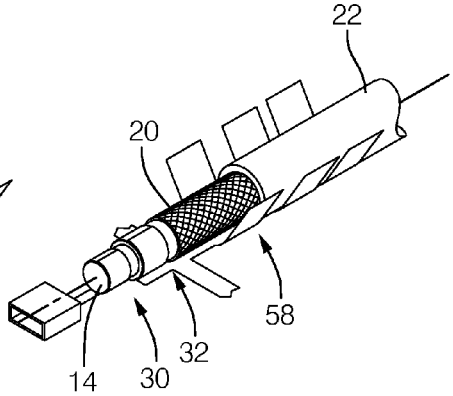

Next, inner ferrule section 58 is positioned radially adjacent to the end portion of conductive shield layer 20 that has been exposed by removing a length of outer insulation layer 22 as shown in FIG. 6. Inner ferrule section 58 is also positioned to axially abut or to be axially proximal to outer insulation layer 22. When inner ferrule section 58 is positioned adjacent to conductive shield layer 20, conductive shield layer 20 extends axially beyond inner ferrule section 58 toward the portion of conductive core 14 that has had core crimp section 30 crimped thereto.

Figure 7:
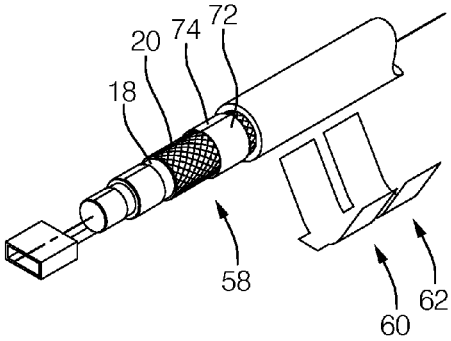

First inner ferrule crimp wing 72 and second inner ferrule crimp wing 74 are then crimped or deformed around conductive shield layer 20 as shown in FIG. 7, thereby fixing inner ferrule section 58 to shielded cable 10. It should be noted that since conductive shield layer 20 radially surrounds core insulation layer 18, the step of crimping or deforming first inner ferrule crimp wing 72 and second inner ferrule crimp wing 74 around conductive shield layer 20 also crimps or deforms first inner ferrule crimp wing 72 and second inner ferrule crimp wing 74 around core insulation layer 18. Carrier strip 100 may be removed from inner ferrule section 58, outer ferrule section 60, and outer ferrule grounding section 62 in the same step that crimps or deforms first inner ferrule crimp wing 72 and second inner ferrule crimp wing 74 around conductive shield layer 20. Similarly, outer ferrule section 60 and outer ferrule grounding section 62 may be separated from inner ferrule section 58 by severing inner ferrule section to outer ferrule section strap 66 (not shown in FIG. 7) in the same step that crimps or deforms first inner ferrule crimp wing 72 and second inner ferrule crimp wing 74 around conductive shield layer 20. Alternatively, outer ferrule section 60 and outer ferrule grounding section 62 may remain attached to inner ferrule section 58.

Figure 8:
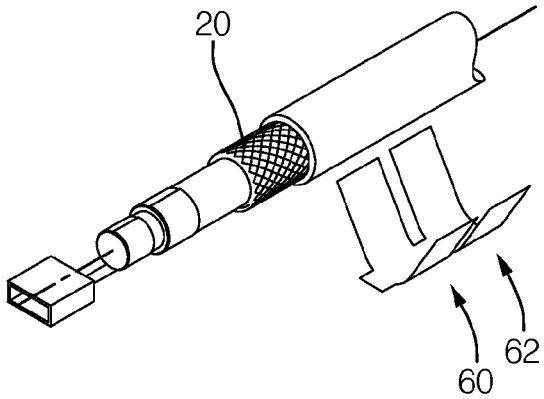

After inner ferrule section 58 has been fixed to shielded cable 10, conductive shield layer 20 is positioned to radially surround inner ferrule section 58 as shown in FIG. 8. Conductive shield layer 20 is positioned to radially surround inner ferrule section 58 by folding conductive shield layer 20 backward over inner ferrule section 58. It should be noted that inner ferrule section 58 is obscured by conductive shield layer 20 in FIGS. 8-10 because conductive shield layer 20 now radially surrounds inner ferrule section 58.

Figure 9:
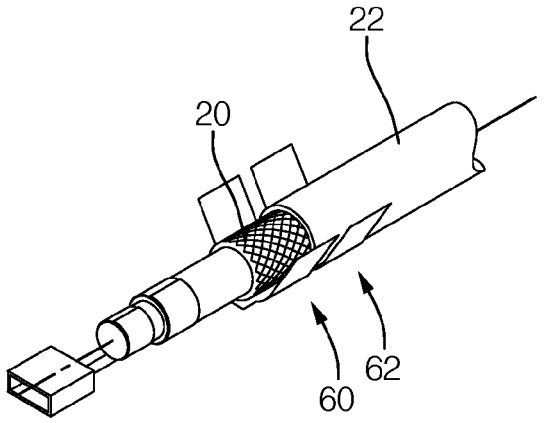

After conductive shield layer 20 is positioned radially outward of inner ferrule section 58, outer ferrule section 60 is positioned radially adjacent to the portion of conductive shield layer 20 that is positioned radially outward of inner ferrule section 58 as shown in FIG. 9. Simultaneously, outer ferrule grounding section 62 is positioned radially outward of outer insulation layer 22. As shown, outer ferrule section 60 may axially abut or may be axially proximal to outer insulation layer 22. If outer ferrule section 60 and outer ferrule grounding section 62 have remained attached to inner ferrule section 58 after the step of crimping or deforming first inner ferrule crimp wing 72 and second inner ferrule crimp wing 74 around conductive shield layer 20 as described alternatively above, the step of positioning outer ferrule section 60 radially adjacent to the portion of conductive shield layer 20 that is positioned radially outward of inner ferrule section 58 includes folding inner ferrule section to outer ferrule section strap 66. More specifically, inner ferrule section to outer ferrule section strap 66 is inverted by bending inner ferrule section to outer ferrule section strap 66 180° at the end attached to inner ferrule section 58 and also 180° at the end attached to outer ferrule section 60. In this way, inner ferrule section to outer ferrule section strap 66 is positioned between conductive shield layer 20 and outer ferrule section 60. Furthermore, inner ferrule section 58 remains attached to outer ferrule section 60 by inner ferrule section to outer ferrule section strap 66.

Figure 10:
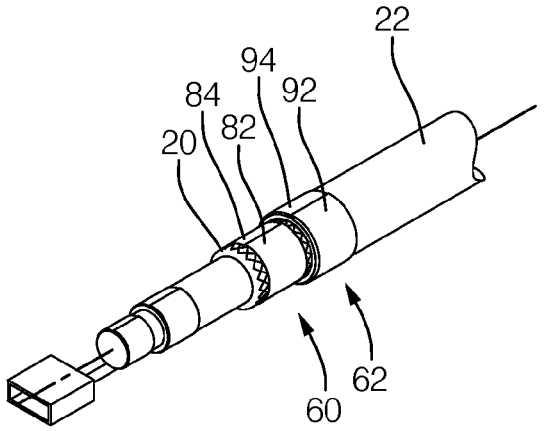

After outer ferrule section 60 has been positioned relative to shielded cable 10 as shown in FIG. 9, first outer ferrule crimp wing 82 and second outer ferrule crimp wing 84 are crimped or deformed around conductive shield layer 20 as shown in FIG. 10, thereby fixing outer ferrule section 60 to shielded cable 10. In this way, conductive shield layer 20 is captured and clamped securely radially between inner ferrule section 58 and outer ferrule section 60, thereby ensuring a good electrically conductive interface between conductive shield layer 20 and outer ferrule section 60. It should be noted that the majority of conductive shield layer 20 is obscured in FIG. 10 because outer ferrule section 60 now radially surrounds conductive shield layer 20.

First outer ferrule grounding wing 92 and second outer ferrule grounding wing 94 may be crimped or deformed around outer insulation layer 22 as shown in FIG. 10 at the same time that first outer ferrule crimp wing 82 and second outer ferrule crimp wing 84 are crimped or deformed around conductive shield layer 20. First outer ferrule grounding wing 92 and second outer ferrule grounding wing 94 may be crimped or deformed around outer insulation layer 22 to either grip outer insulation layer 22 tightly or alternatively an annular space may be formed between outer ferrule grounding section 62 and outer insulation layer 22. It should be noted that first outer ferrule grounding wing 92 and second outer ferrule grounding wing 94 may alternatively be crimped or deformed around outer insulation layer 22 either before or after first outer ferrule crimp wing 82 and second outer ferrule crimp wing 84 are crimped or deformed around conductive shield layer 20.

While inner ferrule section 58 has been shown as being attached to shielded cable 10 in a step after core crimp section 30 and core insulation crimp section 32 are attached to shielded cable 10, it should now be understood that inner ferrule section 58 may be attached to shielded cable 10 simultaneously with core crimp section 30 and core insulation crimp section 32. In order to do this, inner ferrule section 58 is positioned radially adjacent to the end portion of conductive shield layer 20 that has been exposed by removing a length of outer insulation layer 22 at the same time that core crimp section 30 is positioned radially adjacent to the end portion of conductive core 14 that has been exposed by removing a length of core insulation layer 18 and at the same time that core insulation crimp section 32 is positioned radially adjacent to the end portion of core insulation layer 18 that has been exposed by removing a length of conductive shield layer 20. Next, first core crimp section crimp wing 40 and second core crimp section crimp wing 42 are crimped or deformed around conductive core 14, first core insulation crimp section crimp wing 50 and second core insulation crimp section crimp wing 52 are crimped or deformed around core insulation layer 18, and first inner ferrule crimp wing 72 and second inner ferrule crimp wing 74 are crimped or deformed around conductive shield layer 20 simultaneously. Also simultaneously, core insulation crimp section to inner ferrule section strap 64 may be removed to separate inner ferrule section 58 from core insulation crimp section 32, carrier strip 100 may be removed, and inner ferrule section to outer ferrule section strap 66 may be removed to separate outer ferrule section 60 and outer ferrule grounding section 62 from inner ferrule section 58. Next, conductive shield layer 20 is folded backward over inner ferrule section 58 to radially surround inner ferrule section 58. The process for attaching outer ferrule section 60 and outer ferrule grounding section 62 to shielded cable 10 may be the same as described previously. As mentioned previously, the crimp style of first core crimp section crimp wing 40 and second core crimp section crimp wing 42 around conductive core 14 is shown in the figures for illustrative purposes only and any known crimp style may be used, for example only, an f-crimp or an overlap crimp.

Figure 12:
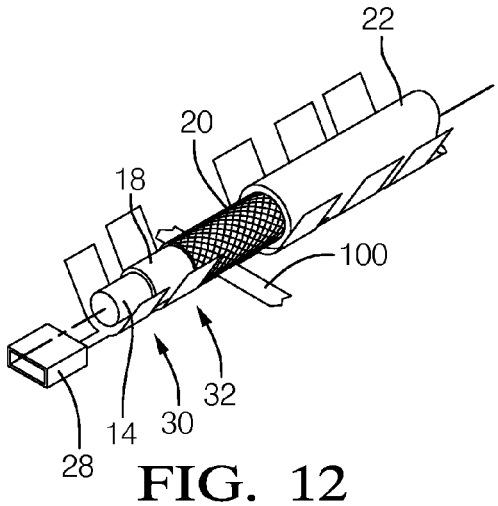

A second embodiment of assembling termination assembly 12 to shielded cable 10 will now be discussed with reference to FIGS. 11-19. As shown in FIG. 11, shielded cable 10 has been prepared as previously described in order to receive termination assembly 12. After shielded cable 10 has been prepared to receive termination assembly 12, core crimp section 30 is positioned radially adjacent to the end portion of conductive core 14 that has been exposed by removing a length of core insulation layer 18 as shown in FIG. 12. Simultaneously, core insulation crimp section 32 is positioned radially adjacent to the end portion of core insulation layer 18 that has been exposed by removing a length of conductive shield layer 20. Core crimp section 30 is also positioned to axially abut or to be axially proximal to core insulation layer 18. Similarly, core insulation crimp section 32 is also positioned to be axially proximal to conductive shield layer 20. Positioning core crimp section 30 and core insulation crimp section 32 as describe results in terminal 28 being positioned axially beyond the end of conductive core 14.

Figure 13:
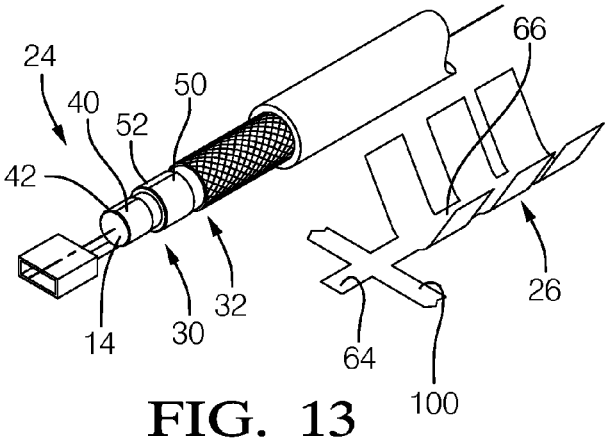

First core crimp section crimp wing 40 and second core crimp section crimp wing 42 are then crimped or deformed around conductive core 14 and first core insulation crimp section crimp wing 50 and second core insulation crimp section crimp wing 52 are crimped or deformed around core insulation layer 18 as shown in FIG. 13, thereby fixing core crimp section 30 in electrical communication with conductive core 14 and fixing core insulation crimp section 32 to core insulation layer 18 to provide strain relief to conductive core 14. The same process which fixes core crimp section 30 to conductive core 14 and core insulation crimp section 32 to core insulation layer 18 may also separate conductive core termination section 24 from core insulation crimp section to inner ferrule section strap 64. In this way, conductive core termination section 24 is also separated from carrier strip 100 and conductive shield termination section 26. It should be noted that carrier strip 100 remains attached to conductive shield termination section 26 at this point in the process. Just as in the first embodiment, the crimp style of first core crimp section crimp wing 40 and second core crimp section crimp wing 42 around conductive core 14 is shown in the figures for illustrative purposes only and any known crimp style may be used, for example only, an f-crimp or an overlap crimp.

Figure 14:
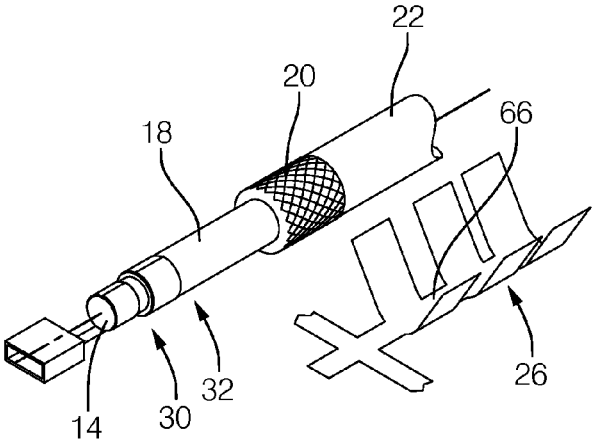
Figure 15:
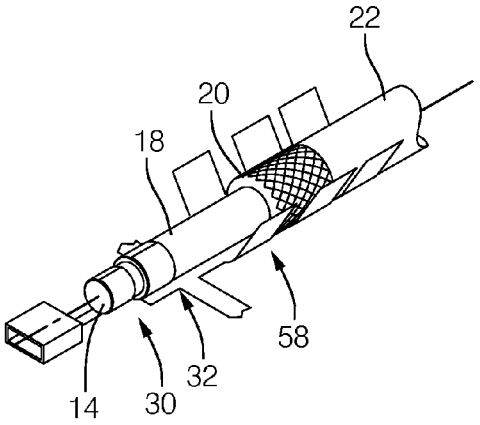

Next, as shown in FIG. 14, the end portion of conductive shield layer 20 that has been exposed is folded backward over outer insulation layer 22. After conductive shield layer 20 has been folded backward over outer insulation layer 22, inner ferrule section 58 is positioned radially adjacent to the portion of core insulation layer 18 that has been exposed by folding conductive shield layer 20 backward over outer insulation layer 22 as shown in FIG. 15. Inner ferrule section 58 is also positioned axially adjacent to conductive shield layer 20 by axially abutting or being axially proximal to conductive shield layer 20. When inner ferrule section 58 is positioned adjacent to core insulation layer 18 and conductive shield layer 20, core insulation layer 18 extends axially beyond inner ferrule section 58 toward the portion of conductive core 14 that has had core crimp section 30 crimped thereto.

Figure 16:
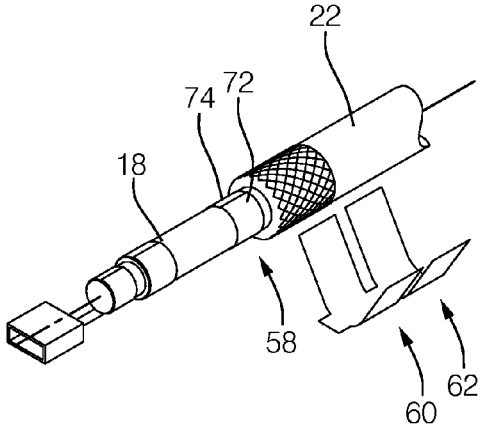

First inner ferrule crimp wing 72 and second inner ferrule crimp wing 74 are then crimped or deformed around core insulation layer 18 as shown in FIG. 16, thereby fixing inner ferrule section 58 to shielded cable 10. Carrier strip 100 may be removed from inner ferrule section 58, outer ferrule section 60 and outer ferrule grounding section 62 in the same step that crimps or deforms first inner ferrule crimp wing 72 and second inner ferrule crimp wing 74 around conductive shield layer 20. Similarly, outer ferrule section 60 and outer ferrule grounding section 62 may be separated from inner ferrule section 58 by severing inner ferrule section to outer ferrule section strap 66 in the same step that crimps or deforms first inner ferrule crimp wing 72 and second inner ferrule crimp wing 74 around conductive shield layer 20. Alternatively, outer ferrule section 60 and outer ferrule grounding section 62 may remain attached to inner ferrule section 58.

Figure 17:
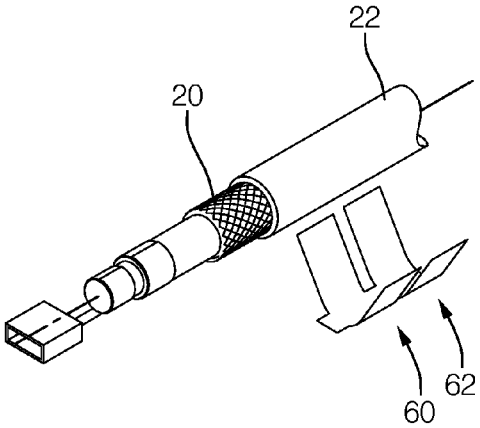

After inner ferrule section 58 has been fixed to shielded cable 10, conductive shield layer 20 is positioned to radially surround inner ferrule section 58 as shown in FIG. 17. Conductive shield layer 20 is positioned to radially surround inner ferrule section 58 by folding conductive shield layer 20 forward over inner ferrule section 58 as shown in FIG. 17. It should be noted that inner ferrule section 58 is obscured by conductive shield layer 20 in FIGS. 17-19 because conductive shield layer 20 radially surrounds inner ferrule section 58. If outer ferrule section 60 and outer ferrule grounding section 62 have remained attached to inner ferrule section 58 after the step of crimping or deforming first inner ferrule crimp wing 72 and second inner ferrule crimp wing 74 around conductive shield layer 20 as described alternatively above, outer ferrule section 60 and outer ferrule grounding section 62 need to be folded forward prior to folding conductive shield layer 20 forward over inner ferrule section 58 by bending inner ferrule section to outer ferrule section strap 66 180° where it attaches to inner ferrule section 58. After outer ferrule section 60 and outer ferrule grounding section 62 have been folded forward, conductive shield layer 20 is folded forward over inner ferrule section 58 and inner ferrule section to outer ferrule section strap 66. In this way, inner ferrule section 58 and inner ferrule section to outer ferrule section strap 66 are surrounded by conductive shield layer 20.

Figure 18:
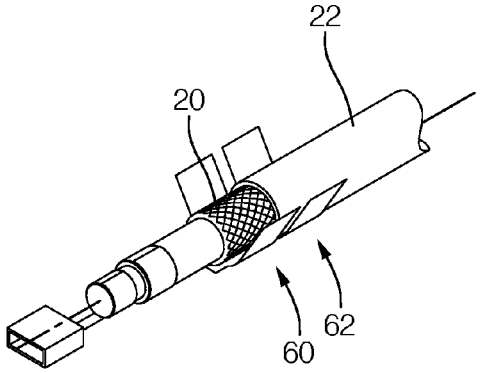

After conductive shield layer 20 is positioned to radially surround inner ferrule section 58, outer ferrule section 60 is positioned radially adjacent to the portion of conductive shield layer 20 that is positioned radially outward of inner ferrule section 58 as shown in FIG. 18. Simultaneously, outer ferrule grounding section 62 is positioned radially outward of outer insulation layer 22. As shown, outer ferrule section 60 may axially abut or may be axially proximal to outer insulation layer 22. If outer ferrule section 60 and outer ferrule grounding section 62 have remained attached to inner ferrule section 58 after the step of crimping or deforming first inner ferrule crimp wing 72 and second inner ferrule crimp wing 74 around conductive shield layer 20 as described alternatively above, the step of positioning outer ferrule section 60 radially adjacent to the portion of conductive shield layer 20 that is positioned radially outward of inner ferrule section 58 includes folding outer ferrule section 60 and outer ferrule grounding section 62 backward by bending inner ferrule section to outer ferrule section strap 66 180° where it attaches to outer ferrule section 60. In this way, inner ferrule section 58 remains attached to outer ferrule section 60 by inner ferrule section to outer ferrule section strap 66.

Figure 19:
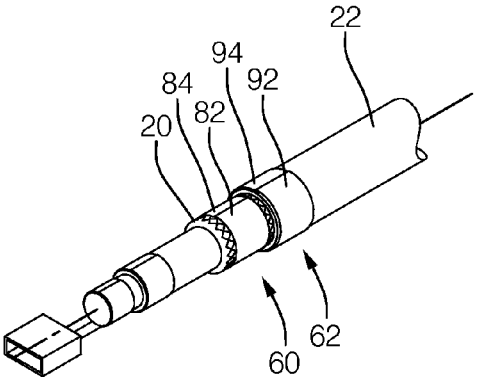

After outer ferrule section 60 has been positioned relative to shielded cable 10 as shown in FIG. 18, first outer ferrule crimp wing 82 and second outer ferrule crimp wing 84 are crimped or deformed around conductive shield layer 20 as shown in FIG. 19, thereby fixing outer ferrule section 60 to shielded cable 10. In this way, conductive shield layer 20 is captured and clamped securely radially between inner ferrule section 58 and outer ferrule section 60, thereby ensuring a good electrically conductive interface between conductive shield layer 20 and outer ferrule section 60. It should be noted that the majority of conductive shield layer 20 is obscured in FIG. 19 because outer ferrule section 60 now radially surrounds conductive shield layer 20.

First outer ferrule grounding wing 92 and second outer ferrule grounding wing 94 may be crimped or deformed around outer insulation layer 22 as shown in FIG. 19 at the same time that first outer ferrule crimp wing 82 and second outer ferrule crimp wing 84 are crimped or deformed around conductive shield layer 20. First outer ferrule grounding wing 92 and second outer ferrule grounding wing 94 may be crimped or deformed around outer insulation layer 22 to either grip outer insulation layer 22 tightly or alternatively an annular space may be formed between outer ferrule grounding section 62 and outer insulation layer 22. It should be noted that first outer ferrule grounding wing 92 and second outer ferrule grounding wing 94 may alternatively be crimped or deformed around outer insulation layer 22 either before or after first outer ferrule crimp wing 82 and second outer ferrule crimp wing 84 are crimped or deformed around conductive shield layer 20.

While inner ferrule section 58 has been shown as being attached to shielded cable 10 in a step after core crimp section 30 and core insulation crimp section 32 are attached to shielded cable 10, it should now be understood that inner ferrule section 58 may be attached to shielded cable 10 simultaneously with core crimp section 30 and core insulation crimp section 32. In order to do this, the end portion of conductive shield layer 20 that has been exposed is folded backward over outer insulation layer 22. Next, inner ferrule section 58 is positioned radially adjacent to the portion core insulation layer 18 that has been exposed by folding conductive shield layer 20 backward over outer insulation layer 22 at the same time that core crimp section 30 is positioned radially adjacent to the end portion of conductive core 14 that has been exposed by removing a length of core insulation layer 18 and at the same time that core insulation crimp section 32 is positioned radially adjacent to the end portion of core insulation layer 18 that has been exposed by removing a length of conductive shield layer 20. Next, first core crimp section crimp wing 40 and second core crimp section crimp wing 42 are crimped or deformed around conductive core 14, first core insulation crimp section crimp wing 50 and second core insulation crimp section crimp wing 52 are crimped or deformed around core insulation layer 18, and first inner ferrule crimp wing 72 and second inner ferrule crimp wing 74 are crimped or deformed around core insulation layer 18 simultaneously. Also simultaneously, core insulation crimp section to inner ferrule section strap 64 may be removed to separate inner ferrule section 58 from core insulation crimp section 32, carrier strip 100 may be removed, and inner ferrule section to outer ferrule section strap 66 may be removed to separate outer ferrule section 60 and outer ferrule grounding section 62 from inner ferrule section 58. Alternatively, as mentioned previously, outer ferrule section 60 and outer ferrule grounding section 62 may remain attached to inner ferrule section 58. Next, conductive shield layer 20 is folded forward over inner ferrule section 58 to radially surround inner ferrule section 58. The process for attaching outer ferrule section 60 and outer ferrule grounding section 62 to shielded cable 10 may be the same as described previously.

Figure 20:
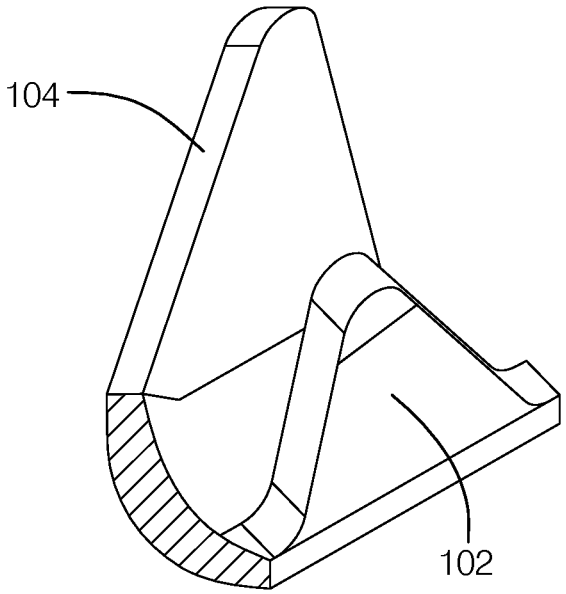
FIG. 20 is an isometric view of a bypass wing arrangement.
Figure 21:
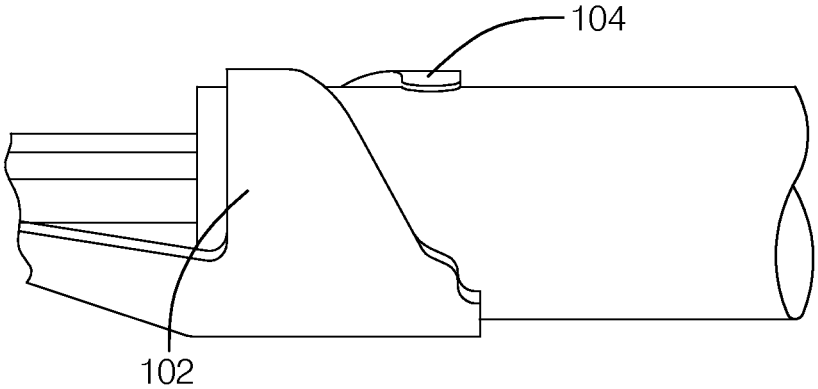
FIG. 21 is the bypass wing arrangement of FIG. 20 shown crimped onto a cable.

First core crimp section crimp wing 40 and second core crimp section crimp wing 42 have been illustrated as rectangular in shape such that when first core crimp section crimp wing 40 and second core crimp section crimp wing 42 have been crimped or deformed, first core crimp section crimp wing free end 44 and second core crimp section crimp wing free end 46 are adjacent to each other. Similarly, first core insulation crimp section crimp wing 50 and second core insulation crimp section crimp wing 52 have been illustrated as rectangular in shape such that when first core insulation crimp section crimp wing 50 and second core insulation crimp section crimp wing 52 have been crimped or deformed, first core insulation crimp section crimp wing free end 54 and second core insulation crimp section crimp wing free end 56 are adjacent to each other. Also similarly, first inner ferrule crimp wing 72 and second inner ferrule crimp wing 74 have been illustrated as rectangular in shape such that when first inner ferrule crimp wing 72 and second inner ferrule crimp wing 74 have been crimped or deformed, first inner ferrule crimp wing free end 76 and second inner ferrule crimp wing free end 78 are adjacent to each other. Similarly, first outer ferrule crimp wing 82 and second outer ferrule crimp wing 84 have been illustrated as rectangular in shape such that when first outer ferrule crimp wing 82 and second outer ferrule crimp wing 84 have been crimped or deformed, first outer ferrule crimp wing free end 86 and second outer ferrule crimp wing free end 88 are adjacent to each other. Also similarly, first outer ferrule grounding wing 92 and second outer ferrule grounding wing 94 have been illustrated as rectangular in shape such that when first outer ferrule grounding wing 92 and second outer ferrule grounding wing 94 are deformed around outer insulation layer 22, first outer ferrule grounding wing free end 96 and second outer ferrule grounding wing free end 98 are adjacent to each other. It should now be understood that the crimp wings and ground wings may be formed in other shapes. Similarly, it should now be understood that different numbers of crimp wings and ground wings may be included. FIGS. 20 and 21 illustrate a bypass wing arrangement with a first bypass wing 102 and a second bypass wing 104 which are each formed as triangles. As can be seen, the triangular nature of first bypass wing 102 and second bypass wing 104 allow the bypass wings to bypass each other, thereby preventing first bypass wing 102 from contacting second bypass wing 104. The triangular nature of first bypass wing 102 and second bypass wing 104 thereby allows different gauge wires to be used with the same ferrule while still allowing first bypass wing 102 and second bypass wing 104 to sufficiently radially surround the cable. First bypass wing 102 and second bypass wing 104 may be used in the place of any or all of first core crimp section crimp wing 40, second core crimp section crimp wing 42, first core insulation crimp section crimp wing 50, second core insulation crimp section crimp wing 52, first inner ferrule crimp wing 72, second inner ferrule crimp wing 74, first outer ferrule crimp wing 82, second outer ferrule crimp wing 84, first outer ferrule grounding wing 92 and second outer ferrule grounding wing 94.

Termination assembly 12 allows for reduced costs by producing conductive core termination section 24, inner ferrule section 58 and outer ferrule section 60, and outer ferrule grounding section 62 as a single piece by punching and stamping of sheet stock rather than by forming individual loose pieces. Plating of conductive core termination section 24, inner ferrule section 58, outer ferrule section 60, and outer ferrule grounding section 62 can therefore be performed on the sheet stock rather than on individual loose pieces. Furthermore, since the wings of the ferrules are made by stamping, they can be designed to accommodate multiple sizes of cable. A further advantage of termination assembly 12 is an increased accuracy in positioning of the various sections of termination assembly 12 relative to shielded cable 10 and a reduced likelihood of errors due to incorrect components being used in the incorrect location. The methods disclosed herein for attaching termination assembly 12 to shielded cable 10 allow conductive core termination section 24 and conductive shield termination section 26 to be more easily and more quickly attached to shielded cable 10, thereby reducing production time and costs.

While this invention has been described in terms of preferred embodiments thereof, it is not intended to be so limited, but rather only to the extent set forth in the claims that follow.

We claim:

1. A termination assembly for a shielded cable that includes a conductive core, a core insulation layer radially surrounding said conductive core, a conductive shield layer radially surrounding said core insulation layer, and an outer insulation layer radially surrounding said conductive shield layer, said termination assembly comprising:

a terminal;

a core crimp section in electrical communication with said terminal and configured to be crimped around said conductive core in electrical communication therewith;

an inner ferrule section connected to said core crimp section and configured to be crimped around said core insulation layer;

an outer ferrule section connected to said inner ferrule section and configured to be crimped around said inner ferrule section; and an outer ferrule grounding section in electrical communication with said outer ferrule section and configured to be crimped around said outer insulation layer; and a core insulation crimp section connected to said core crimp section and configured to be crimped around said core insulation layer.

2. The terminal assembly as in claim 1 wherein said core crimp section is axially between said terminal and said inner ferrule section.

3. The terminal assembly as in claim 1 wherein said core insulation crimp section is axially between said core crimp section and said inner ferrule section.

4. The terminal assembly as in claim 1 wherein said inner ferrule section is axially between said core crimp section and said outer ferrule section.

5. The terminal assembly as in claim 1 wherein said outer ferrule section is axially between said inner ferrule section and said outer ferrule grounding section.

6. The terminal assembly in claim 1 wherein:

said core crimp section includes a core crimp section base portion having a first core crimp section crimp wing and a second core crimp section crimp wing extending from opposing sides of said core crimp section base portion;

said inner ferrule section includes an inner ferrule section base portion having a first inner ferrule crimp wing and a second inner ferrule crimp wing extending from opposing sides of said inner ferrule base portion;

said outer ferrule section includes an outer ferrule section base portion having a first outer ferrule crimp wing and a second outer ferrule crimp wing extending from opposing sides of said outer ferrule base portion; and said outer ferrule grounding section includes an outer ferrule grounding section base portion having a first outer ferrule grounding section crimp wing and a second outer ferrule grounding section crimp wing extending from opposing sides of said outer ferrule grounding section base portion.

7. The terminal assembly as in claim 6 wherein said outer ferrule section is axially between said inner ferrule section and said outer ferrule grounding section.

8. The terminal assembly as in claim 6 wherein said outer ferrule section base portion is connected to said outer ferrule grounding section base portion by an outer ferrule section to outer ferrule grounding section strap.

9. The terminal assembly as in claim 8 wherein said outer ferrule section to outer ferrule grounding section strap axially spaces said outer ferrule grounding section from said outer ferrule section.

10. The terminal assembly as in claim 1 wherein said inner ferrule section is connected to said core crimp section between said inner ferrule section and said core crimp section.

* * * * *